US005271517A

United States Patent [19]

Bowers

[11] Patent Number: 5,271,517

[45] Date of Patent: Dec. 21, 1993

[54] TAMPER EVIDENT LID

[75] Inventor: Paul Bowers, Ledgewood, N.J.

[73] Assignee: The Pillsbury Company, Minneapolis, Minn.

[21] Appl. No.: 898,083

[22] Filed: Jun. 12, 1992

[51] Int. Cl.[5] ..... B65D 17/40

[52] U.S. Cl. ..... 220/276; 220/306

[58] Field of Search ..... 220/266, 268, 270, 276, 220/306, 660; 215/253, 254, 256, 252; 29/400.1, 422, 428, 455.1

[56] References Cited

U.S. PATENT DOCUMENTS

| | | | |
|---|---|---|---|
| 3,805,993 | 4/1974 | Enzie et al. | 220/276 X |
| 4,657,153 | 4/1987 | Hayes | 215/252 |
| 4,732,289 | 3/1988 | Granat et al. | 215/252 |

*Primary Examiner*—Allan N. Shoap
*Assistant Examiner*—Nova Stucker
*Attorney, Agent, or Firm*—Kinney & Lange

[57] ABSTRACT

A tamper evident container in which the container bottom has an outwardly extending lip at the top and the lid has a downwardly extending shirt which includes a tear-strip. The tear-strip has a locking ring which is hinged to the tear-strip so that it may stably occupy either of two positions. The first position being downward and the second position being upward to engage the lip when the lid is first used. The pushing of the lid downwardly moves the ring from the first to the second position to prevent removal of the lid without use of the tear-strip.

4 Claims, 4 Drawing Sheets

12
50
20
5B
5B 12
50
14
30
16
28
40
40
10
34

TAMPER EVIDENT LID

BACKGROUND OF THE INVENTION

1. Field of the Invention

The present invention relates to containers, and more particularly, to a closure for a container which provides visual indication to a consumer when the lid has been previously removed.

2. Description of the Prior Art

A large number to tamper proof and tamper evident containers have been proposed in the prior art. One of the most successful methods is to provide a lid which requires the removal of a portion thereof along a "tear-strip" line since, after opening, the torn part cannot be reasonably reassociated with the lid and the evidence of tampering is manifest. Such lids, however, require that there be no reasonable alternate way of removing the lid without tearing the strip and, a number of solution to this problem have also been proposed. One such arrangement is to provide an inwardly extending locking piece attached to the tear strip and arranged at an angle upwardly so as to catch an outwardly extending portion of the cup shaped container. Such an apparatus is seen in patents such as the Krout U.S. Pat. No. 4,476,993 issued Oct. 16, 1984, the Smith U.S. Pat. No. 4,493,432 issued Jan. 15, 1995, the Bordner U.S. Pat. No. 4,718,571 issued Jan. 12, 1988, the Chumley et al. U.S. Pat. No. 4,881,656 issued Nov. 21, 1989 and the Smith U.S. Pat. No. 5,002,198 issued Mar. 26, 1991. The locking arrangements of such patents can be successful in making the lid of the container difficult to remove without obviously harming the lid itself or without tearing the tear-strip as long as the lock is properly applied. Some of these structures apply the locking device in only a few places spaced around the periphery of the container which may permit bending of the device out of the way of the outwardly extending portion of the container. A better arrangement is to have a completely locking ring extending around the entire periphery as in the Smith U.S. Pat. No. 5,002,198 mentioned above. However, a difficulty is encountered in the Smith arrangement because the upwardly extending conical locking ring is formed as an integral part of the downwardly extending tear strip and, when the lid is inserted over the rim of the container, the ring is supposed to be moved aside to permit the rim of the container to move past the locking ring and spring back to a position under the outwardly extending portion so that any attempted upward movement of the lid thereafter will cause the locking rim to engage the lip of the container and prevent opening. Unfortunately, the forcing of the lid over the upwardly extending conical locking ring may not, in all cases, provide assurance that the conical locking ring has in fact moved back into engagement with the lip of the container. More particularly, if the container lid is not pressed all the way down a portion or the locking ring may be wedged against the lip of the container which would then allow a careful removal of the lid without tearing the strip or damaging the lid or container. It is desirable to have a more positive locking arrangement without loosing the inherent desirability of the conical locking ring arrangement.

SUMMARY OF THE INVENTION

The present invention overcomes the problem in the prior art by supplying a second weakened portion between the locking ring and the tear-strip which acts as a hinge joining the locking ring to the tear-strip on the skirt of the lid. With this arrangement, the locking ring may start in a downwardly sloping configuration but as the lid is pushed down over the container, it hinges about the weakened portion and snaps over to an upwardly extending conical locking ring. When downwardly extending, the locking ring will engage the top surface of the container rim and as further downward pressure is exerted it will cross an over-center position and will snap to an upwardly extending position against the side of the container below the rim and thus assure positive engagement of the, now upwardly extending conical locking ring, with the outwardly extending lip portion of the container.

DETAILED DESCRIPTION OF THE PREFERRED EMBODIMENTS

Figure 1:
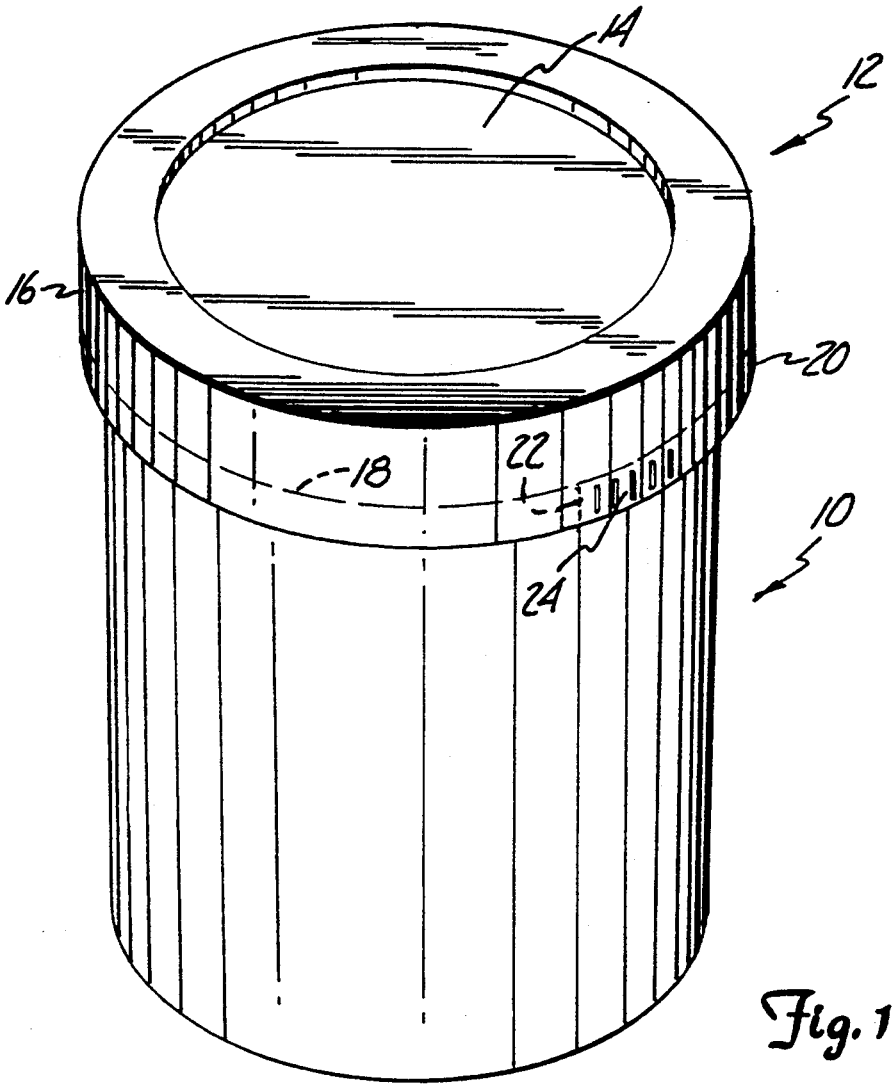
FIG. 1 shows a perspective view of a container with a tear-strip portion shown in the lid.

FIG. 1 shows a container 10 suitable for containing consumer products such as ice cream. The container may be made from paper with a polyethylene coating. FIG. 1 also shows a lid 12 operable to fit over the top of container 10 so as to close it from contamination with the environment. The lid 12 is shown with a horizontal portion 14 and a peripheral, downwardly extending skirt 16, the lower portion of which is connected to the upper portion by a weakened line shown by dash line 18 which may be made by perforating the material of the skirt 16 or causing it to be significantly thinner than the rest of the skirt along the line 18. The lower portion of skirt 16 therefore becomes a tear-strip 20 which may be removed by grabbing the tear-strip near a weak part shown by dash line 22 and pulling outwardly away from the container 10. Small ridges such as shown by lines 24 may be placed in the tear-strip 20 to facilitate grabbing thereof.

As will be explained in connection with the remaining figures, tear-strip 20 is provided with an upwardly extending locking ring which is operable to engage an outwardly extending rim at the top of container 10 and prevent the non-damaging removal of the lid 12 except by removal of tear-strip 20. Thus, any prior removal of the lid 12 from container 10 will become obvious to a purchaser who may then reject the container as possibly having been tampered with.

Figure 2A:
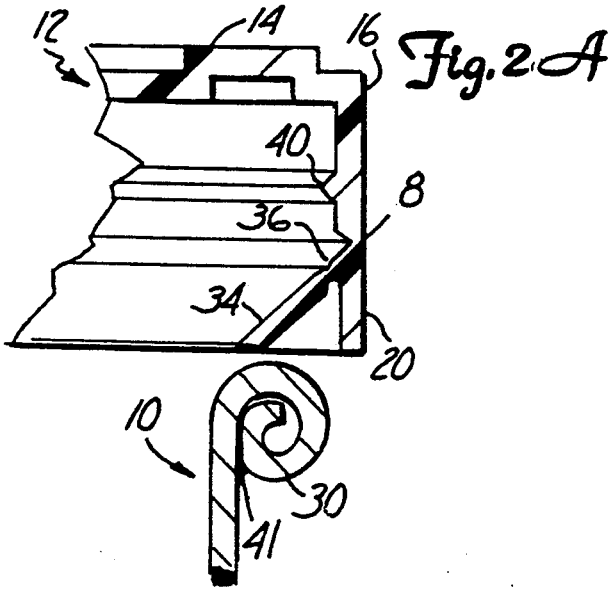
FIG. 2*a* shows a fragmented cross section of a portion of the lid and the container prior to closure.

FIG. 2*a* shows a fragment of a cross sectional view of a portion of container 10 and lid 12 prior to closure. As seen in FIG. 2*a*, the container 10 has a outwardly extending lip 30 which may be formed by rolling the polyethylene coated paper back on itself and then sealing it by the application of heat to melt the coatings together.

Figure 2B:
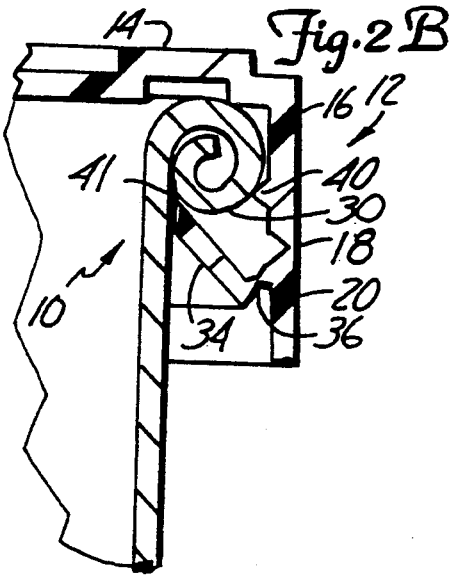
FIG. 2*b* shows the fragmented cross section of FIG. 2*a* subsequent to closure.

Also as seen in FIG. 2*a*, the tear-strip 20 includes a downwardly extending and conical locking ring 34 which is joined to the upper portion of the tear-strip 20 at a weakened point 36 so that the locking ring 34 is hinged to the tear-strip 20 at point 36 and can form two natural positions (i.e., the downwardly extending position shown in FIG. 2*a* or an upwardly extending position shown in FIG. 2*b*). Any motion of locking ring 34 from the position shown in FIG. 2*a* to the position shown in FIG. 2*b* is accompanied by a snap acting over-center motion as the locking ring 34 passes the horizontal position from the downwardly extending to the upwardly extending one. In FIG. 2*b*, the container 10 and lid 12 are shown in a closed position with the rolled lip 30 of the container moved up to the position in contact with the top portion 14 of lid 12. In this position, a seal between the contents of the container and the outside environment is made. It will be noted that an outwardly extending bump or ridge 40 is shown positioned on the inside edge of the skirt 16 so as to provide a rest for the lower portion of the outwardly extending lip 30 when closed. It will also be noted in FIG. 2*b* that the locking ring 34 has been snapped to its upward position where it now engages the lower portion of the lip 30 at an angle thereto. As can be seen, any attempt to remove the lid 12 from the container 10 will be prevented by the locking ring 34 moving up into the "v" shaped groove 41 between the sides of container and the bottom of the lip 30. Accordingly, the container will be sealed and safe from opening until such time as the consumer desires to open the container by removal of the tear-strip 20. It should also be noted in FIGS. 2*a* and 2*b* that the position of the weaken portion 36 joining locking ring 34 to the tear-strip 20 is relatively close to the weakened portion 18 joining the tear-strip 20 to the skirt 16 of lid 12. Thus when the consumer removes tear-strip 20 such action will be accompanied by a tearing along the line of point 36 since the upwardly extending locking ring 34 in its engagement with the lip 30 will not come away with the tear-strip 20. This is desirable since if it were possible to move the locking ring 34 away with the tear-strip 20, it would be possible to insert a tool allowing the tear-strip 34 to move away from the container 10 under and around the lip 30 and provide a possibility that the lid could be removed without utilizing the tear-strip feature.

Figure 3A:
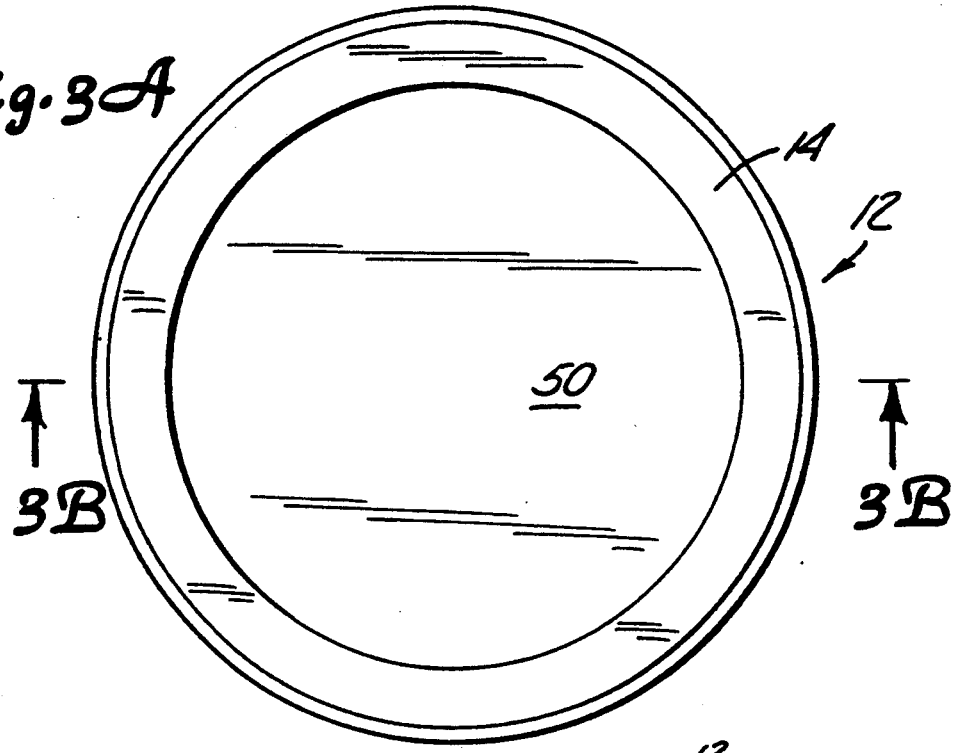
FIG. 3*a* shows the top view of a closed container.
Figure 3B:
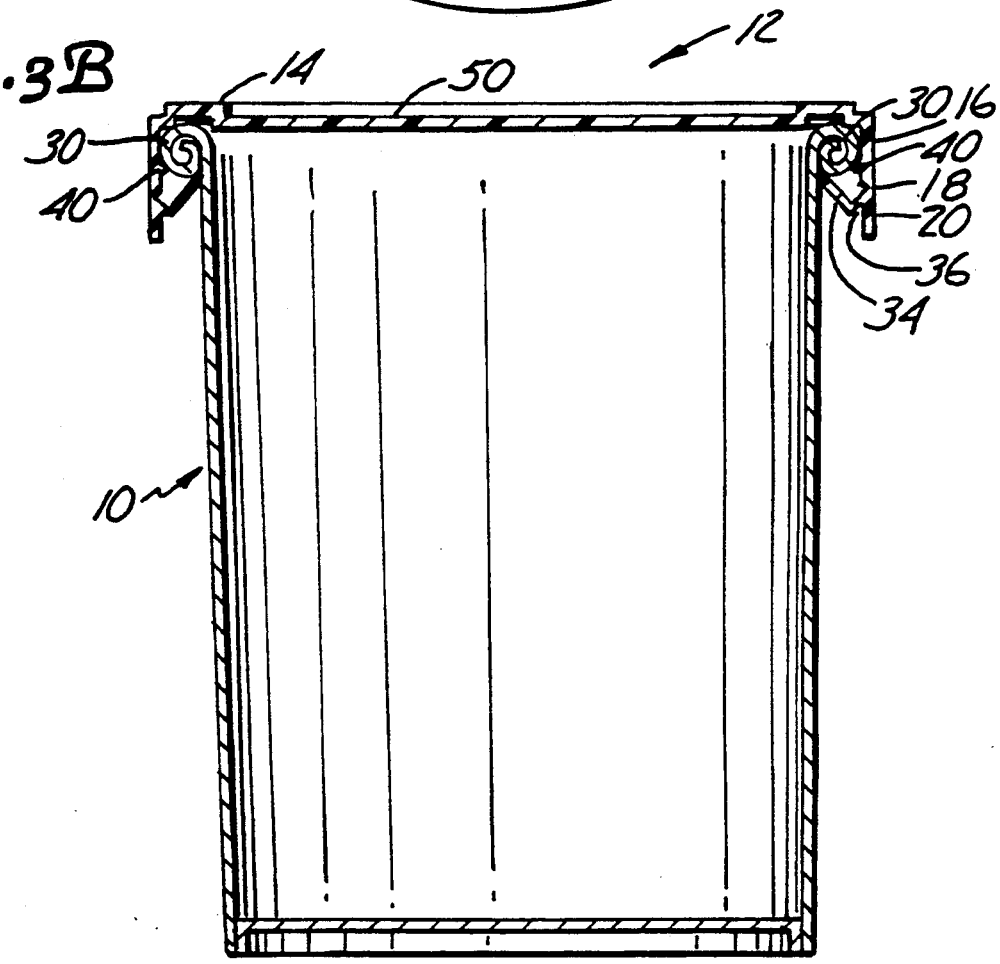
FIG. 3*b* shows a cross sectional view of a closed container.

Turning now to FIGS. 3*a* and 3*b* showing a closed container prior to any attempt to remove the lid it will be seen that the lid 12 is closing container 10 with the rolled lip 30 in contact with the top 14 which has been configured so as to provide a somewhat lower central portion 50 in the center of the lid. The lid, which can be made out of polyethylene, is seen to be in contact with the top of the rolled portion 30 and the bottom of rolled portion 30 is in contact with the bump or ridge 40. This not only acts to help seal the container but acts to allow the lid to be reseated after it has been once removed. It will be observed from FIG. 3*b* that the attempted removal of lid 12 from container 10 will be prevented by the locking ring 34.

Figure 4A:
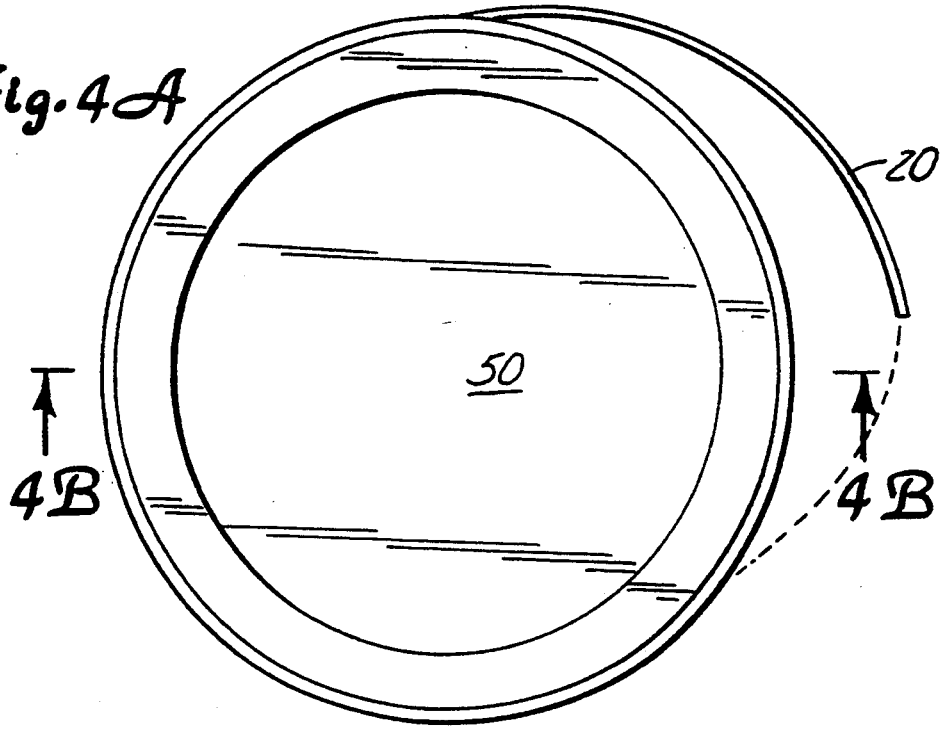
FIG. 4*a* shows the top view of the container of FIG. 3*a* after the tear-strip has been partly removed.
Figure 4B:
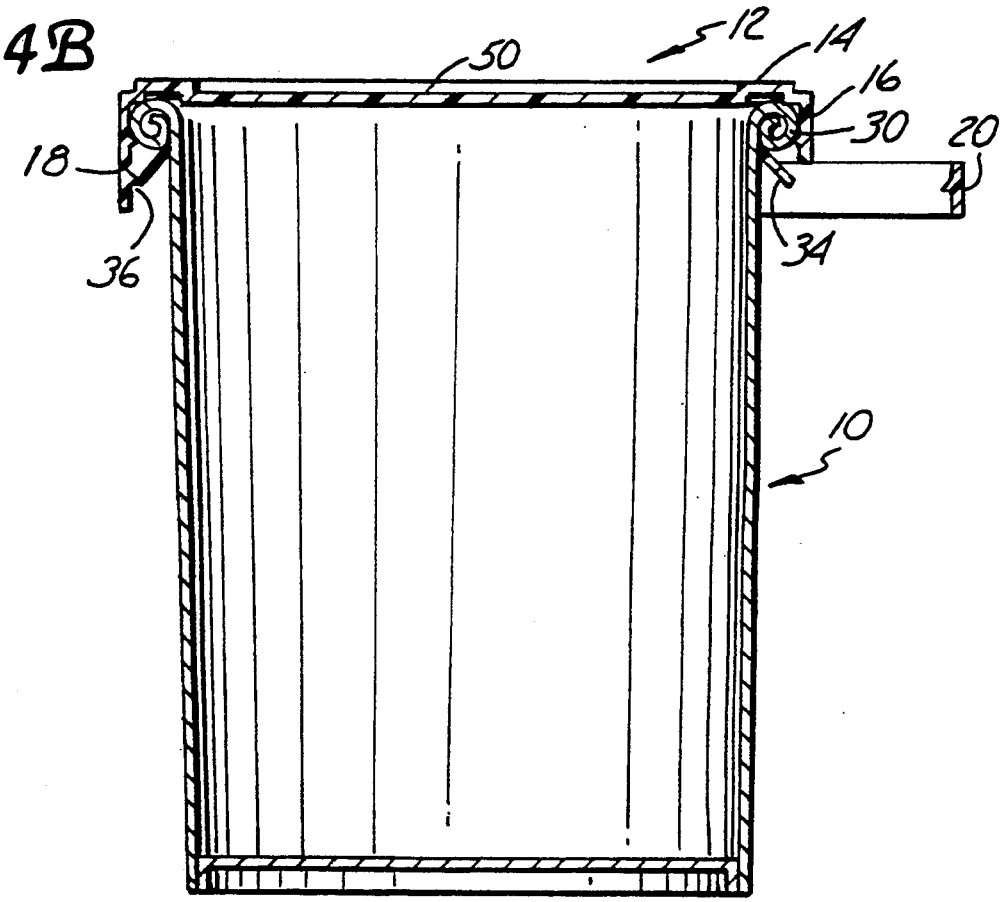
FIG. 4*b* shows the cross sectional view of the container of FIG. 3*b* with the tear strip partially removed.

In FIGS. 4*a* and 4*b* the containers shown in FIGS. 3*a* and 3*b* are reshown with the tear-strip 20 partly removed. It should be observed on the right hand portion of FIG. 4*b* that the tear-strip 20 has separated not only from the skirt 16 but also from the upwardly extending locking ring 34 leaving it still in contact with the rolled lip 30 as it was in FIG. 3*b*.

Figure 5A:
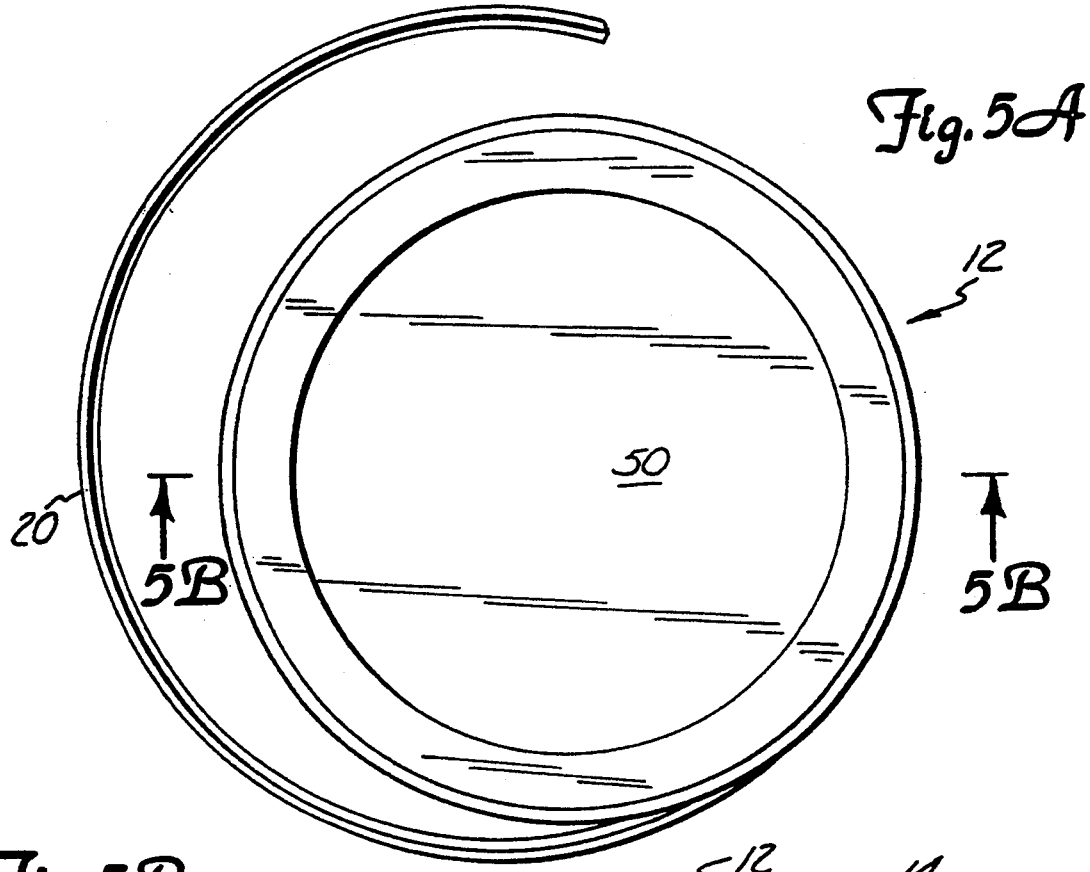
FIG. 5*a* shows the top view of the container of FIG. 3*a* with the tear-strip completely removed.
Figure 5B:
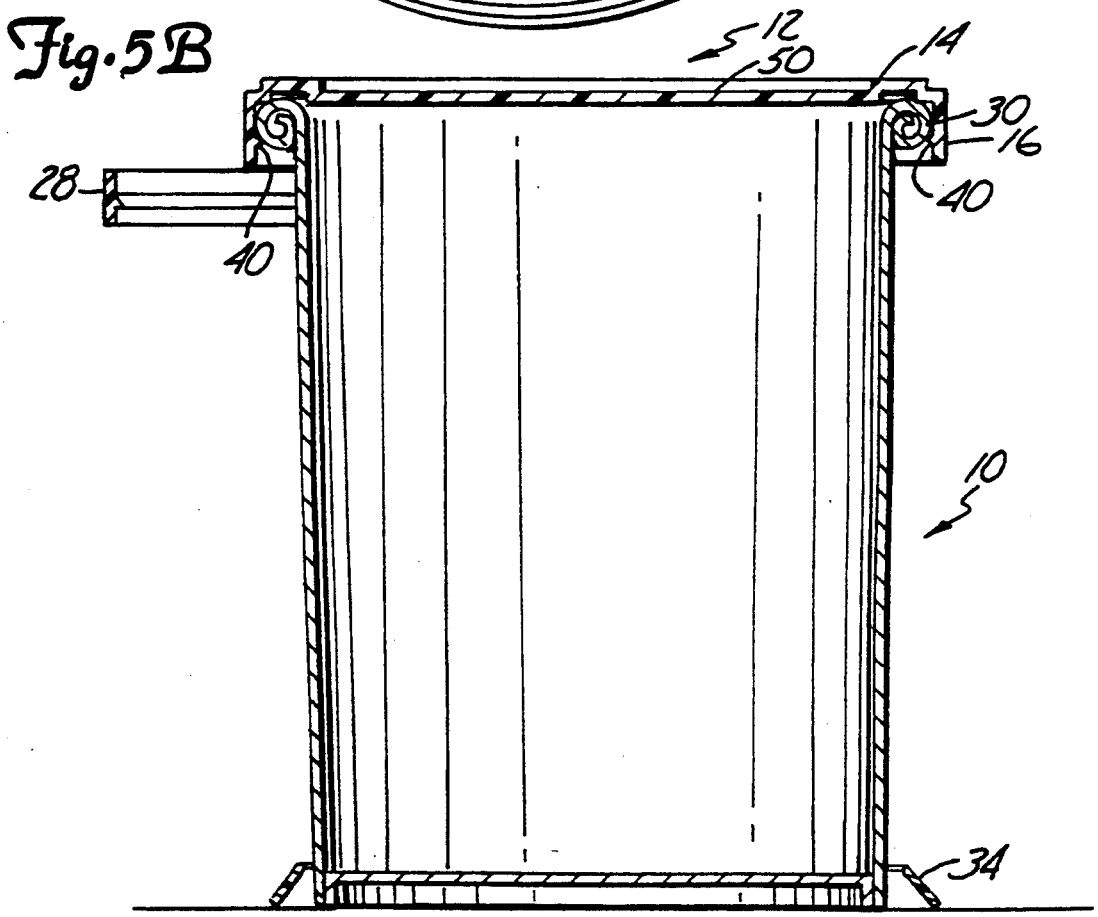
FIG. 5*b* shows the cross sectional view of the container of FIG. 3*b* with the tear-strip completely removed and the locking ring disengaged.

FIGS. 5*a* and 5*b* show the container and lid of FIGS. 3*a* and 3*b* with a tear-strip 20 now completely separated from the skirt 16 of lid 12. It should be noted in FIG. 5*b* that the locking ring 34 has now become complete separated from the tear-strip 28 and, as such has fallen down around the bottom of the container 10 where it can be removed and thrown away along with the tear-strip 28. Note also in FIG. 5*b*, that the lid 12 continues to seal the container 10 from the outside environment by virtue of the rolled portion 30 bearing against the top 14 of lid 12 and against the bump or ridge 40 remaining in the downwardly extending skirt 16. Removal of the lid now becomes relatively easy, however, since a slight force upwardly on lid 12 will cause the bump 40 to move past the rolled edge 30 thereby permitting access to the contents of the container 10. After use, the lid may be conveniently replaced by a slight force downwards causing the lip 40 to re-engage top 14 and ridge 40 as shown in FIG. 5*b*.

It is therefore seen that I have provided a tamper evident container which overcomes the difficulties of the prior art by providing a locking ring which is connected to a tear-strip in such a manner that it can be in a downward position prior to closure and which will snap into a locking upward position after closure so as to prevent any attempt to remove the lid without obvious damage and yet to allow easy access by use of the tear-strip which not only is removed from the downwardly extending skirt but is also removed from the locking ring upon tearing.

Although the present invention has been described with reference to preferred embodiments, workers skilled in the art will recognize that changes may be made in form and detail without departing from the spirit and scope of the invention.

What is claimed is:

1. In a tamper evident container having a closed bottom portion with upwardly extending sides ending with an outwardly extending lip, and a lid having a downwardly extending peripheral skirt adapted to fit over the lip and to extend downwardly along but spaced from the container sides, said lid including:

a first weakened portion forming a tear line around the periphery of the skirt to provide a tear strip therein;

a locking ring having an inner edge and an outer edge, the outer edge being connected to the skirt by a second weakened portion to form a second tear line, the ring being in a locked position extending upwardly from the skirt to engage the underneath portion of the lip to resist removal of the lid until the tear strip is removed which simultaneously tears along the first and second weakened portions permitting the tear strip and the locking ring to independently detach from the skirt.

2. Apparatus according to claim 1 wherein the lip has a diameter, the inner edge of the locking ring has a diameter, and the second weakened portion operates as a hinge to permit rotation between the locking ring and the skirt and enable the locking ring to occupy a first stable position extending at a angle downwardly from the skirt prior to the closing of the container, the diameter of the inner edge of the locking ring being less than the diameter of the lip so that, upon pressing the lid onto the container, the locking ring is rotated upwardly past an over center position to move positively into the locked position.

3. In a tamper evident container having a closed bottom portion with upwardly extending sides ending with an outwardly extending lip having a diameter and an underneath portion, and a lid having a downwardly extending peripheral skirt adapted to fit over the lip and to extend downwardly along but spaced from the container sides, said lid including:

a first weakened portion forming a tear line around the periphery of the skirt to provide a tear strip therein;

a locking ring having an inner edge with a diameter and an outer edge, the outer edge being connected to the skirt by a second weakened portion to form a hinge to permit rotation between the locking ring and the skirt and enable the locking ring to occupy a first stable position extending at an angle downwardly from the skirt prior to closing of the container, the diameter of the inner edge of the locking ring being less than the diameter of the lip so that, upon pressing the lid onto the container, the locking ring is rotated upwardly past an over center position to move positively into a second position extending at an angle upwardly from the skirt with the inner edge engaging the underneath portion of the lip to thereafter resist removal of the lid until the tear strip is removed which simultaneously removes the locking ring to permit removal of the lid and provide obvious evidence of the opening of the container, and wherein the second weakened portion forms a second tear line and both the first and second weakened portions separately tear upon removal of the tear strip.

4. Apparatus according to claim 3 wherein the locking ring is conical and remains intact after being separated.

* * * * *